US008973554B2

(12) United States Patent
Park et al.

(10) Patent No.: US 8,973,554 B2
(45) Date of Patent: Mar. 10, 2015

(54) TWO SOLENOID VALVE RELAY TWO-STAGE FUEL INJECTION VALVE FOR DIESEL ENGINES

(75) Inventors: Deuk-Jin Park, Ulsan (KR); Eung-Sung Kim, Ulsan (KR); Ju-Tae Kim, Ulsan (KR); Kang-Yun Jung, Ulsan (KR); Kwang-Cheol Heo, Ulsan (KR); Jong-Suk Kim, Ulsan (KR); Jung-Hyun Park, Ulsan (KR); Eun Ha, Ulsan (KR); Beom-Yong No, Ulsan (KR)

(73) Assignee: Hyundai Heavy Industries, Co., Ltd., Ulsan (KR)

( * ) Notice: Subject to any disclaimer, the term of this patent is extended or adjusted under 35 U.S.C. 154(b) by 266 days.

(21) Appl. No.: 13/642,276

(22) PCT Filed: Oct. 26, 2010

(86) PCT No.: PCT/KR2010/007363

§ 371 (c)(1),
(2), (4) Date: Oct. 19, 2012

(87) PCT Pub. No.: WO2011/132832

PCT Pub. Date: Oct. 27, 2011

(65) Prior Publication Data

US 2013/0037004 A1 Feb. 14, 2013

(30) Foreign Application Priority Data

Apr. 21, 2010 (KR) ..... 10-2010-0036790

(51) Int. Cl.
*F02M 45/08* (2006.01)
*F02M 47/02* (2006.01)
(Continued)

(52) U.S. Cl.
CPC ..... *F02M 45/086* (2013.01); *F02M 47/027* (2013.01); *F02M 2200/46* (2013.01); *F02M 61/182* (2013.01)
USPC ..... 123/299; 123/304

(58) Field of Classification Search
CPC ..... F02M 69/16; F02M 45/086; F02M 61/04; F02M 2200/46
USPC ..... 123/495, 299, 300, 304, 305, 490, 499; 239/585.5, 585.1
See application file for complete search history.

(56) References Cited

U.S. PATENT DOCUMENTS 4,546,739 A 10/1985 Nakajima et al.
2003/0066509 A1 4/2003 Shafer et al.
(Continued)

FOREIGN PATENT DOCUMENTS

JP 2002-130086 A 5/2002
JP 2002-188541 A 7/2002
(Continued)

*Primary Examiner* — Mahmoud Gimie
(74) *Attorney, Agent, or Firm* — Rabin & Berdo, P.C.

(57) ABSTRACT

The present invention provides a two solenoid valve relay with a two-phase fuel injection valve for a diesel engine, which is installed on a valve itself to enable injection at pressure greater than opening pressure, at which the fuel enters into a fuel valve, thereby improving fuel injection performance, and which is configured to enable adjustment of an injection timing at the opening pressure within the valve, wherein injection timings through a solenoid valve is provided for low load and high load, respectively, such that a distinct difference exists between the injection timings to open the nozzle hole of the nozzle in a differential manner at pressure higher than the pressure, at which the fuel enters to the fuel valve and internal spring opening pressure, thereby injecting fuel at high pressure even at low load to facilitate vaporization, and wherein, in case of a high speed operation or high load, low pressure/high pressure needle valves are opened at the same time to quickly inject fuel of a high volume through a plurality of nozzle holes, thereby improving combustion performance of an engine, and wherein a space between the needle valve and the nozzle hole which are closed after the injection is minimized because the nozzle hole is opened differentially and sequentially according to pressure, thereby avoiding waste of fuel and reducing harmful gas (smoke, Nox).

6 Claims, 15 Drawing Sheets

(51) Int. Cl.
*F02M 61/18* (2006.01)
*F02M 45/00* (2006.01)

(56) References Cited

U.S. PATENT DOCUMENTS

2007/0246561 A1 10/2007 Gibson
2007/0290075 A1 * 12/2007 Junger et al. ..... 239/533.2
2009/0139487 A1 * 6/2009 Dingle ..... 123/445
2010/0012092 A1 * 1/2010 Futonagane et al. ..... 123/457

FOREIGN PATENT DOCUMENTS

JP 2008-261309 A 10/2008
KR 100742512 B1 * 7/2007

* cited by examiner

<Wartsila-Sulzer Approach> <MAN-B&W Approach> <4 stroke Approach>

TWO SOLENOID VALVE RELAY TWO-STAGE FUEL INJECTION VALVE FOR DIESEL ENGINES

TECHNICAL FIELD

The present invention relates to a fuel injection valve having a two phase fuel injection apparatus, and more particularly to, a two solenoid valve relay with a two-phase fuel injection valve for a diesel engine in which a number of nozzle holes of the fuel injection valve, which injects fuel to a cylinder according to pressure of fuel discharged from a fuel pump in a large marine engine and a medium size engine, is changed such that two solenoid valves are interworked to operate at a time point of low load and a time point of high load to actively cope with low pressure and high pressure, thereby enabling opening an area of the low load and the high load at a random time point and reducing a residual fuel amount remaining in an injection passage after injection, to produce improved combustion performance and higher fuel economy.

BACKGROUND ART

Typically, a conventional diesel engine has one needle valve and one spring, wherein the needle valve is opened when fuel having pressure higher than opening pressure is introduced and is closed when the fuel has lower pressure.

In this manner, when fuel of high pressure formed in a fuel pump enters to a fuel valve, if the pressure higher than the opening pressure is formed within the fuel valve, through pressure of fuel oil, the spring lifts the needle valve against a force pressing against the needle valve, such that fuel is injected into a cylinder through multiple nozzle holes located on an end terminal of a nozzle. Such a method consists of one mechanism in which all nozzle holes are opened according to a predefined one opening pressure, and thus, after the opening pressure is formed, even if higher pressure is introduced to the fuel valve, injection should be continued only through a predefined number of nozzle holes. Therefore, when an operation of an engine at low speed or low load continues, the injection does not occur and, with respect to the pressure higher than the opening pressure, the injection occurs through all nozzle holes regardless of a level of pressure such that an injection pattern is not proportional to pressure and an injection amount cannot be adaptively controlled based on pressure. Also, since multiple fabricated nozzle holes open or close at the same time, residue fuel remaining between the closed needle valve and the nozzle after the injection is finished flows into the cylinder through the nozzle hole, thereby causing a problem related to exhaust gas and fuel economy.

Referring to FIG. 15, a Wartsila-Sulzer approach, an MAN-B & W approach, and a medium-size engine, which are a representative form of a conventional fuel valve, are described. In the Wartsila-Sulzer approach, when pressure is greater than the opening pressure but fails to form a high pressure, fuel flows into the cylinder rather than being injected into the cylinder through multiple nozzle holes fabricated on the nozzle. Also, even after the fuel injection is finished, a space (SAC volume) between the closed needle valve and the nozzle hole is large such that residue fuel remaining in this space flows into the cylinder, thereby causing the problem of harmful gas as described above. In the MAN-B & W approach, a needle valve in a slide method is adopted to reduce the SAC volume, however, the MAN-B & W approach has limitation in that the pressure beyond the opening pressure may not be actively coped with. In other words, although the SAC volume is fixed, according to the present invention, the SAC volume, which is a space between the low-pressure needle valve and nozzle, can be minimized after the injection is finished.

As shown in FIG. 15, in order for the needle valve to open at a predetermined pressure, a spring pressure is increased and fuel pressure is artificially increased in an apparatus other than the fuel valve to adjust the opening pressure; however, in the present invention, pressure is increased within the fuel valve such that fuel may be injected at high pressure even at low load.

In the conventional technology of FIG. 15, an injection timing is not determined by the fuel valve itself and the fuel previously introduced is injected at a predetermined pressure. In other words, the injection timing and maximum pressure of fuel oil is adjusted at a timing of introducing the fuel through fuel pump or other medium. In this regard, the present invention is configured to adjust the fuel injection timing by the fuel valve itself to adjust a time period to be prior to/subsequent to formation of the high pressure, thereby reducing harmful gas through optimum combustion.

DISCLOSURE OF INVENTION

Technical Problem

Therefore, the present invention has been made in view of the above-mentioned problems, and the present invention is to provide a two solenoid valve relay with a two-phase fuel injection valve for a diesel engine, which is installed on a valve itself to enable injection at pressure greater than opening pressure, at which the fuel enters into a fuel valve, thereby improving fuel injection performance, and which is configured to enable adjustment of an injection timing at the opening pressure within the valve, wherein injection timings through a solenoid valve is provided for low load and high load, respectively, such that a distinct difference exists between the injection timings to open the nozzle hole of the nozzle in a differential manner at pressure higher than the pressure, at which the fuel enters to the fuel valve and internal spring opening pressure, thereby injecting fuel at high pressure even at low load to facilitate vaporization, and wherein, in case of a high speed operation or high load, low pressure/high pressure needle valves are opened at the same time to quickly inject fuel of a high volume through a plurality of nozzle holes, thereby improving combustion performance of an engine, and wherein a space between the needle valve and the nozzle hole which are closed after the injection is minimized because the nozzle hole is opened differentially and sequentially according to pressure, thereby avoiding waste of fuel and reducing harmful gas (smoke, Nox).

Technical Solution

In accordance with an aspect of the present invention, provided is a two-phase fuel injection valve for injecting fuel into a cylinder for a diesel engine, including: a distinguishing means configured to distinguish a pressure of fuel entering to a fuel valve into two phases of a low load and a high load, wherein the low load requires lower engine power and the high load requires higher engine power; a nozzle including a low pressure nozzle hole which is opened at the low load and a high pressure nozzle hole which is opened at the high load; a low pressure injection means configured to inject the fuel by opening only the low pressure nozzle hole in case of the low load to inject the fuel; and a high pressure injection means configured to inject the fuel by simultaneously opening the low pressure nozzle hole as well as the high pressure nozzle hole in case of the high load to inject the fuel.

Meanwhile, the distinguishing means includes a low pressure solenoid valve configured to operate when the low load is applied to open only a low pressure nozzle valve and a high pressure solenoid valve configured to operate with the low pressure solenoid valve when the high load is applied to simultaneously open the low pressure nozzle valve as well as the high pressure nozzle hole.

Also, the low pressure injection means includes a low pressure needle spring connected with a low pressure solenoid valve, which operates at the low load and a low pressure, through a fuel passage; a low pressure booster spindle connected with the low pressure needle spring; a low pressure needle valve connected with the low pressure booster spindle; and a low pressure shuttle valve configured to discharge the fuel at a low pressure.

Further, the low pressure injection means stands by fuel pressure from the low pressure needle valve to a high pressure needle valve through a fuel oil inlet, wherein, at the same time, fuel through the lower pressure shuttle valve and a high pressure shuttle valve affects the low pressure booster spindle and a high pressure booster spindle to operate at atmospheric pressure such that the low pressure needle valve and the high pressure needle valve stand by at pressure higher than pressure of the fuel entering from an injection hole, and when required pressure of the low load is reached, the low pressure solenoid is operated such that relative pressure applied to the low pressure booster spindle is discharged to a drainage through a lifting bush valve to interwork with the low pressure needle valve, thereby opening the low pressure nozzle hole to inject the fuel.

Still further, the high pressure injection means includes a high pressure needle spring connected with a high pressure solenoid valve, which operates at the high load and high pressure, through a fuel passage; a high pressure booster spindle connected with the high pressure needle spring; and a high pressure needle valve connected with the high pressure booster spindle.

Still further, fuel pressure stands by from a low pressure needle valve (120) to the high pressure needle valve (121) through a fuel oil inlet (170) wherein, at the same time, fuel through a lower pressure shuttle valve (150) and a high pressure shuttle valve (151) affects a low pressure booster spindle (143) and the high pressure booster spindle (141) to operate at atmospheric pressure such that the low pressure needle valve (120) and the high pressure needle valve (121) stand by at pressure higher than pressure of the fuel entering from an injection hole, and when required pressure of the high load is reached, a low pressure solenoid valve (202) is operated such that relative pressure applied to the high pressure booster spindle (143) is discharged to a drainage (172) through a lifting bush valve (181) to interwork with the high pressure needle valve (121), thereby openly injecting the fuel through a nozzle on which the high pressure nozzle hole (161) is fabricated.

Still further, the fuel injection valve for injecting fuel into a cylinder in the diesel engine further includes a fuel valve block connected with a high pressure pipe, a nozzle holder which surrounds an entire fuel valve, a high pressure needle spring which is connected with a fuel passage bush and operates at high pressure, a high pressure booster spindle coupled with the high pressure needle spring and keep high pressure at low speed and low load pressure, a high pressure needle valve coupled with the high pressure booster spindle, a low pressure needle spring which surrounds the high pressure booster spindle, a low pressure booster spindle coupled with the low pressure needle spring such that the high pressure booster spindle passes therethrough, a low pressure needle valve coupled with the pressure booster spindle, a nozzle on which a low pressure nozzle hole for injecting the fuel to a cylinder and a high pressure nozzle hole for injecting the fuel to the cylinder at high speed and high load pressure are fabricated, a low pressure solenoid valve and a high pressure solenoid valve which adjust an injection time point at a low pressure and a high pressure, lifting bush valves coupled with the low pressure solenoid valve and the high pressure solenoid valve, and a low pressure shuttle valve and a high pressure shuttle valve which distinguishes fuel depending on a pressure difference.

As described above, in the present invention, pressure is increased through an internal apparatus to be higher than pressure at which fuel is injected by a fuel injection apparatus, thereby increasing injection pressure. In other words, injection can be performed at higher pressure even in low load and two solenoid valves are relayed for low pressure and high pressure to perform injection, while an injection timing is delayed or fastened in accordance with the pressure.

Also, by differentially opening fuel by a two phase nozzle hole through a solenoid, a discharge area of fuel is decreased according to a pressure difference, thereby improving an injection shape, and a large amount of fuel is quickly injected altogether at highest pressure by a nozzle hole to obtain good combustion performance at low pressure or high pressure, and fuel passage is narrowed in overall such that such that a residue fuel which remains in the oil passage after the injection and flows to a combustion cylinder is decreased, thereby removing harmful gas (smoke or Nox) and improving fuel economy.

Figure 1:
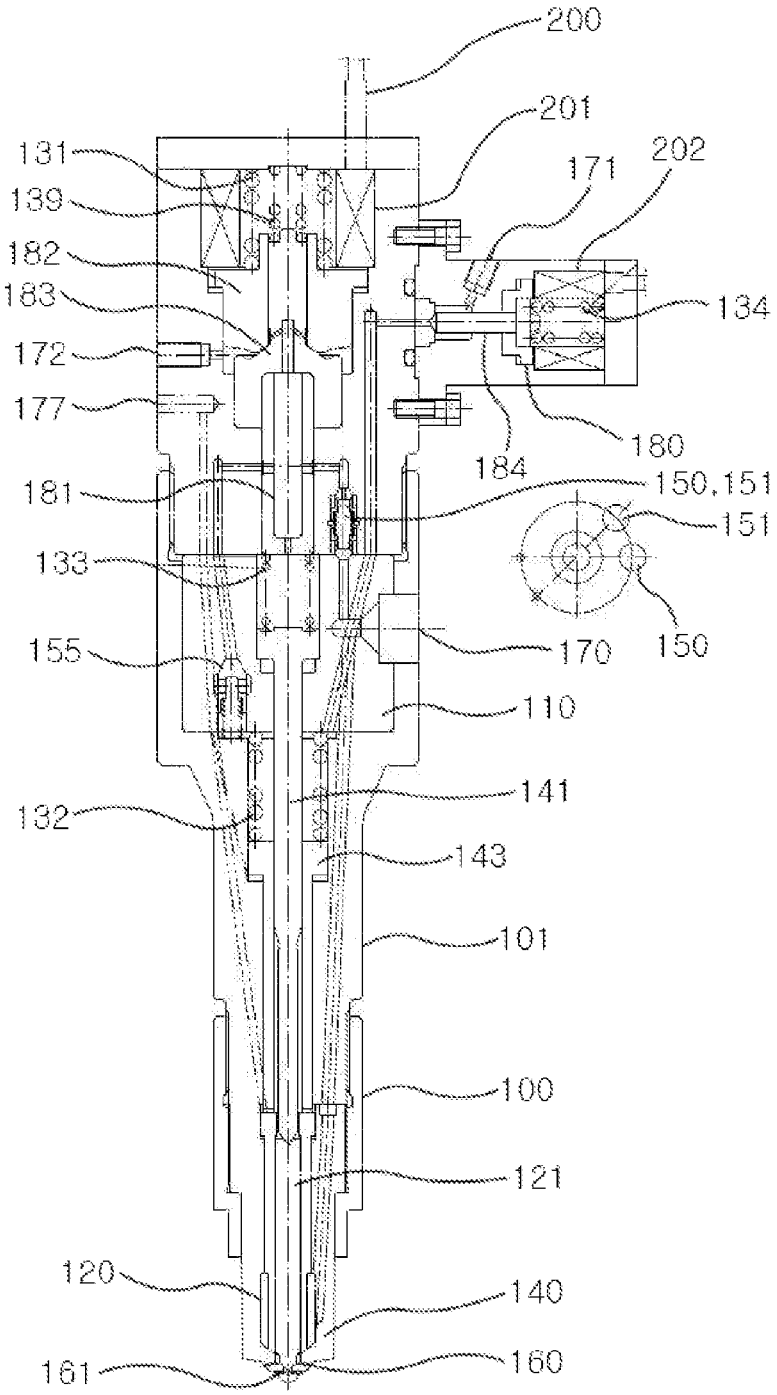
FIG. 1 is a cross sectional view illustrating an exemplary embodiment of the present invention.

100: Nozzle holder
101: Fuel valve block
120: Low pressure needle valve
120: High pressure needle valve
131: High pressure solenoid valve spring
134: Low pressure solenoid valve spring
132: Low pressure needle spring
133: High pressure needle spring
140: Nozzle
141: High pressure booster spindle
143: Low pressure booster spindle
150, 151: Low pressure shuttle valve
155: High pressure shuttle valve
160: Low pressure nozzle hole
161: High pressure nozzle hole
170: Fuel oil inlet
171: Low pressure fuel drainage
172: High pressure fuel drainage
177: Air drainage
180: Low pressure lifting bush valve
181: Fuel passage bush
182, 183: High pressure lifting bush valve
200: Governor cable
201: High pressure solenoid valve
202: Low pressure solenoid valve

MODE FOR THE INVENTION

Exemplary embodiments of the present invention will be described herein below with reference to the accompanying drawings. In the following description, a detailed description of known functions and configurations incorporated herein will be omitted when it may obscure the subject matter of the present invention.

Figure 2:
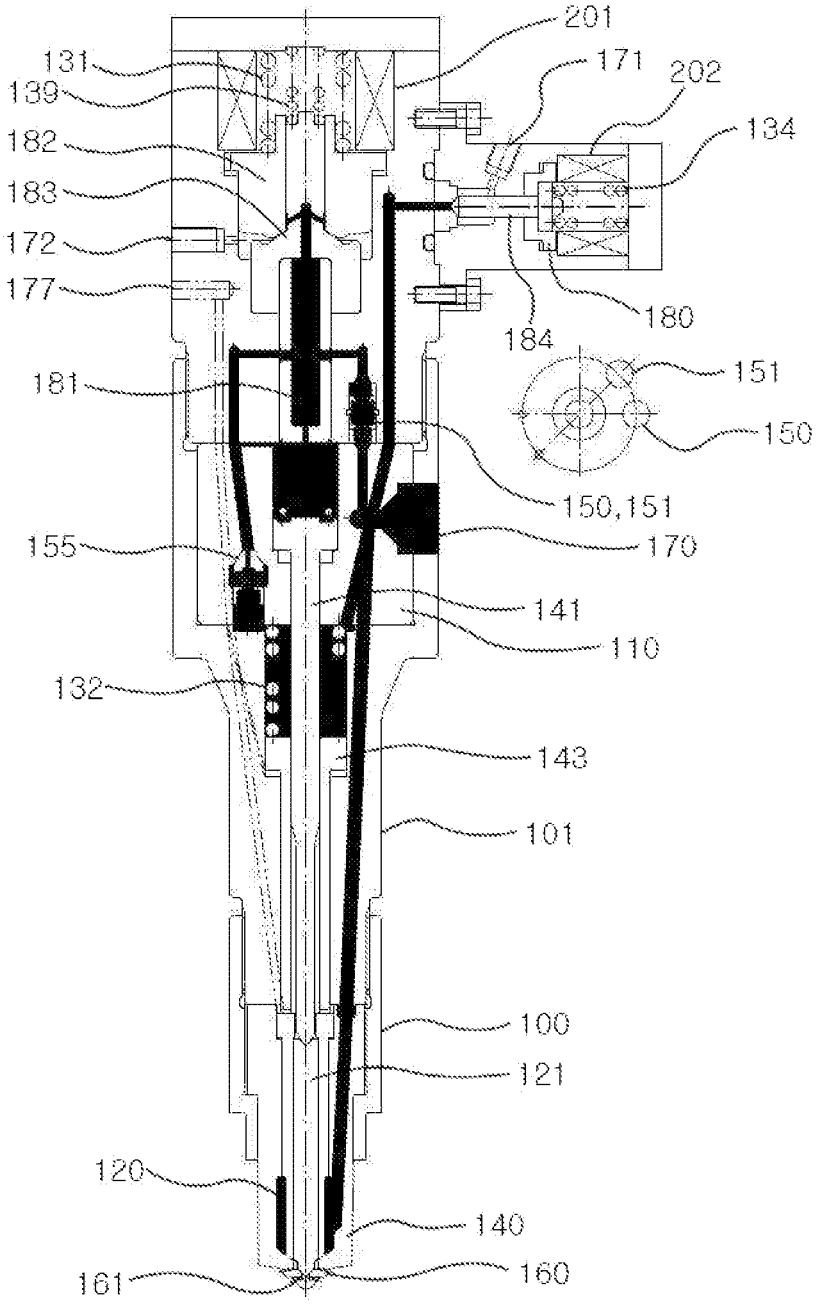
FIG. 2 is a cross sectional view illustrating an exemplary embodiment prior to fuel injection of the present invention.
Figure 3:
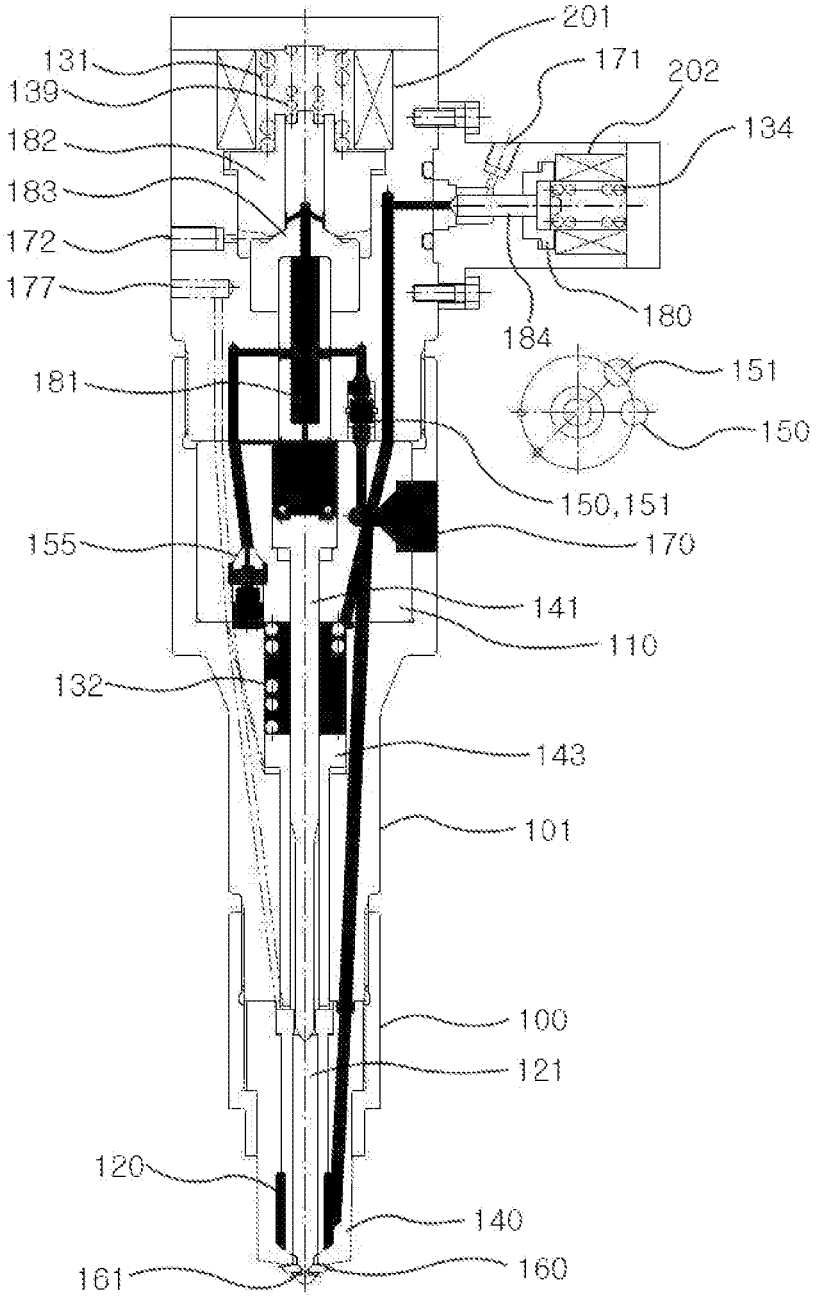
FIG. 3 is a cross sectional view illustrating an exemplary embodiment prior to fuel opening of the present invention.
Figure 4:
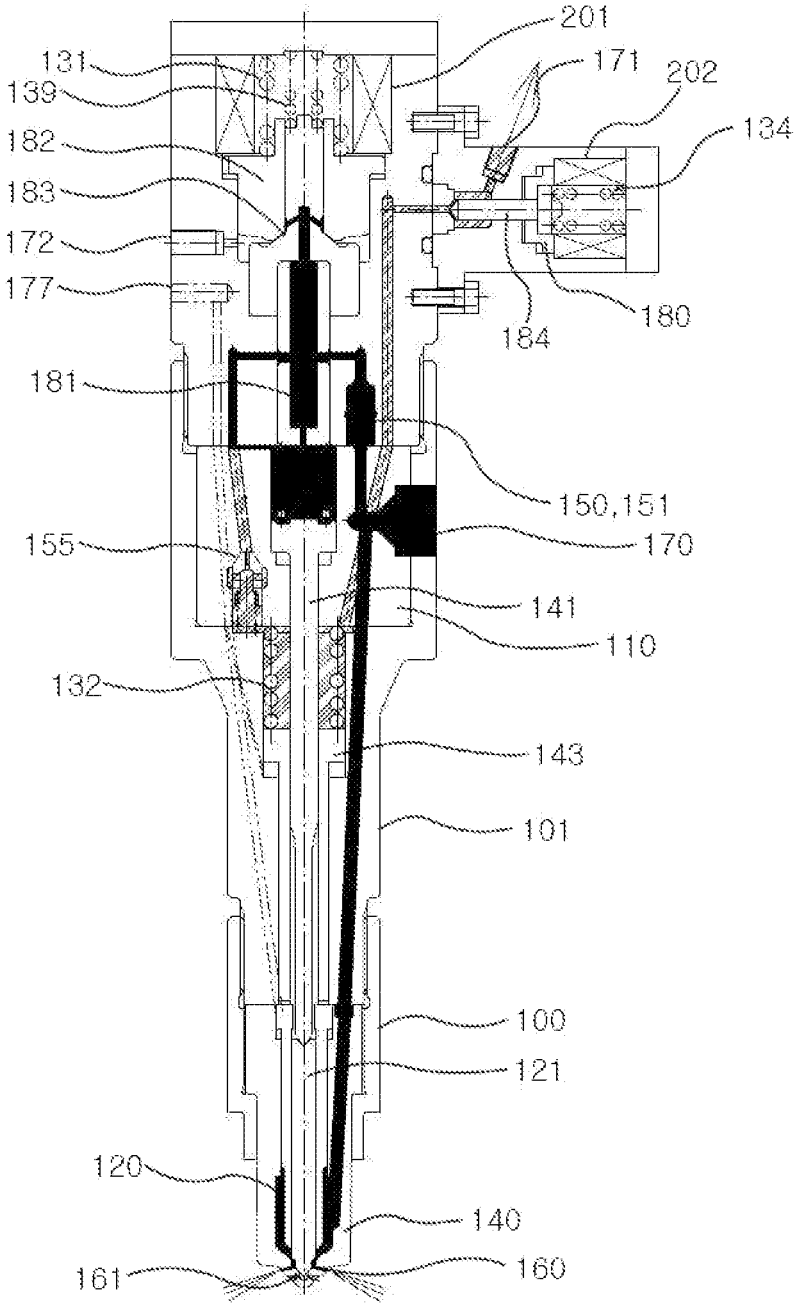
FIG. 4 is a cross sectional view illustrating an image of injection by primary pressure due to an operation of a primary solenoid valve in a case of low load.
Figure 5:
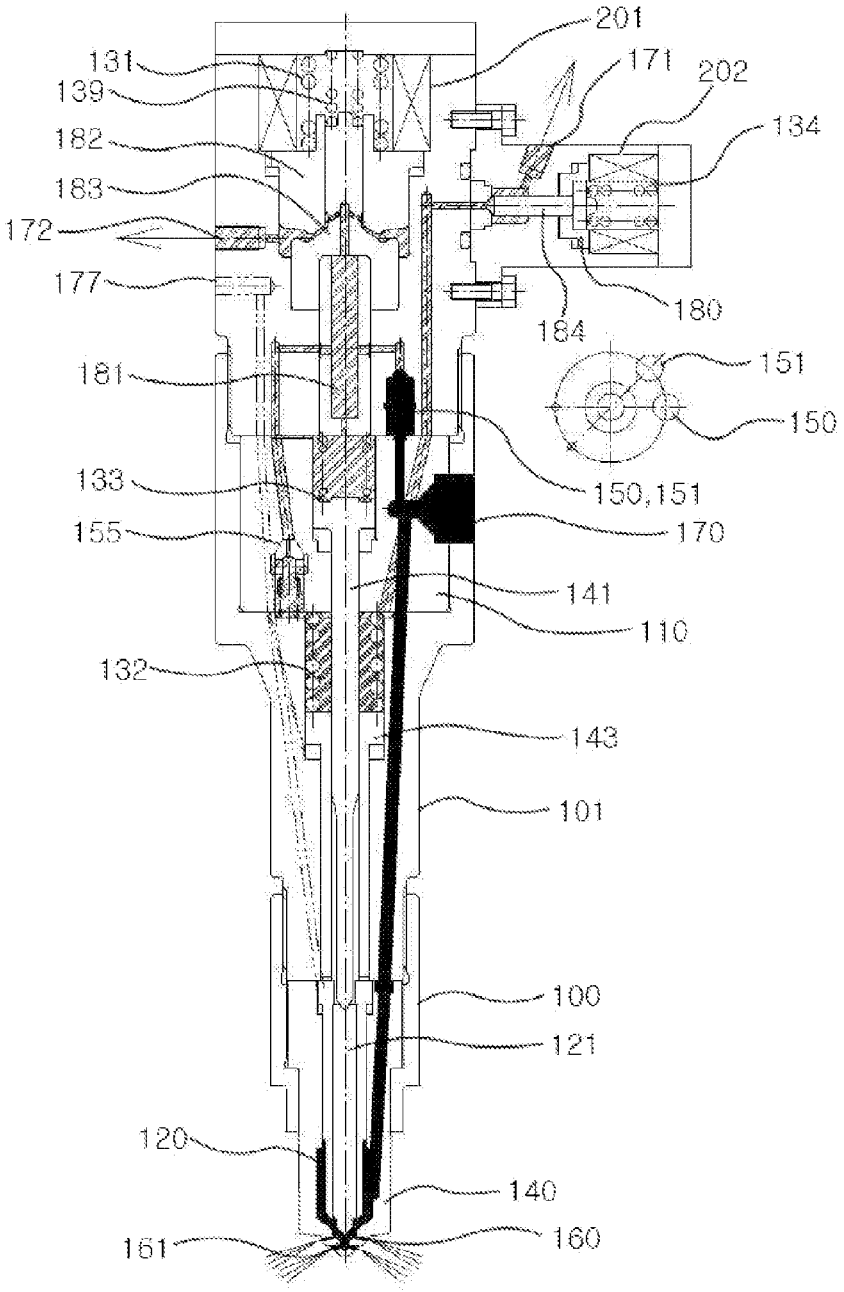
FIG. 5 is a cross sectional view illustrating an image of injection by secondary pressure due to an operation of a secondary solenoid valve in a case of high load.
Figure 6:
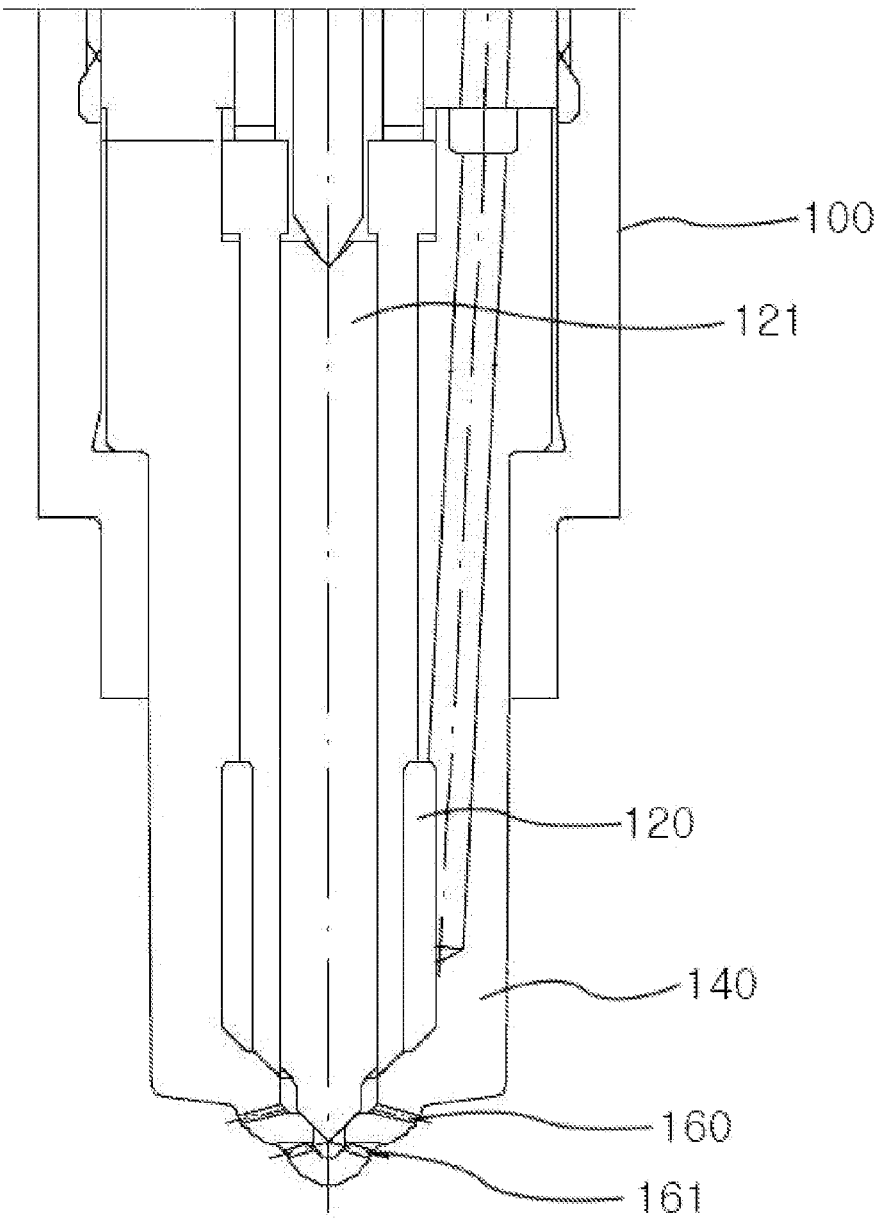
FIG. 6 is a cross sectional view illustrating a standby state during a process of injecting fuel by a stroke of a needle valve in primary and secondary injection.
Figure 8:
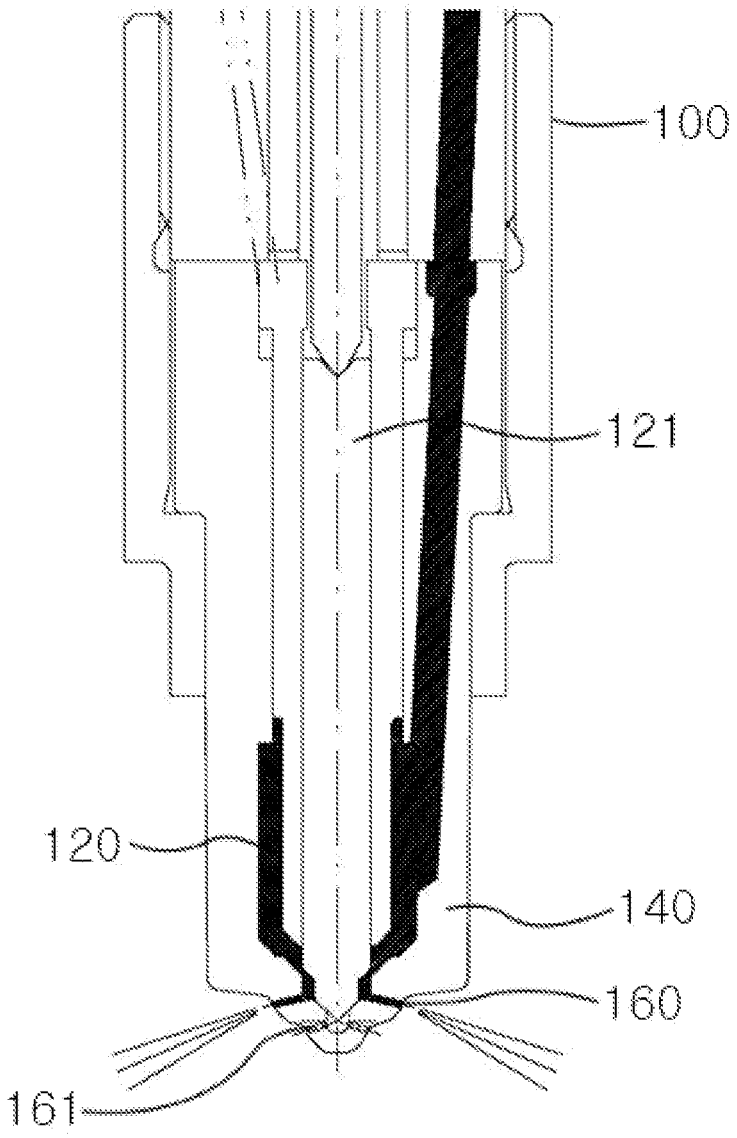
FIG. 8 is a cross sectional view illustrating injection by a low pressure nozzle hole during a process of injecting fuel by a stroke of a needle valve in primary and secondary injection.
Figure 9:
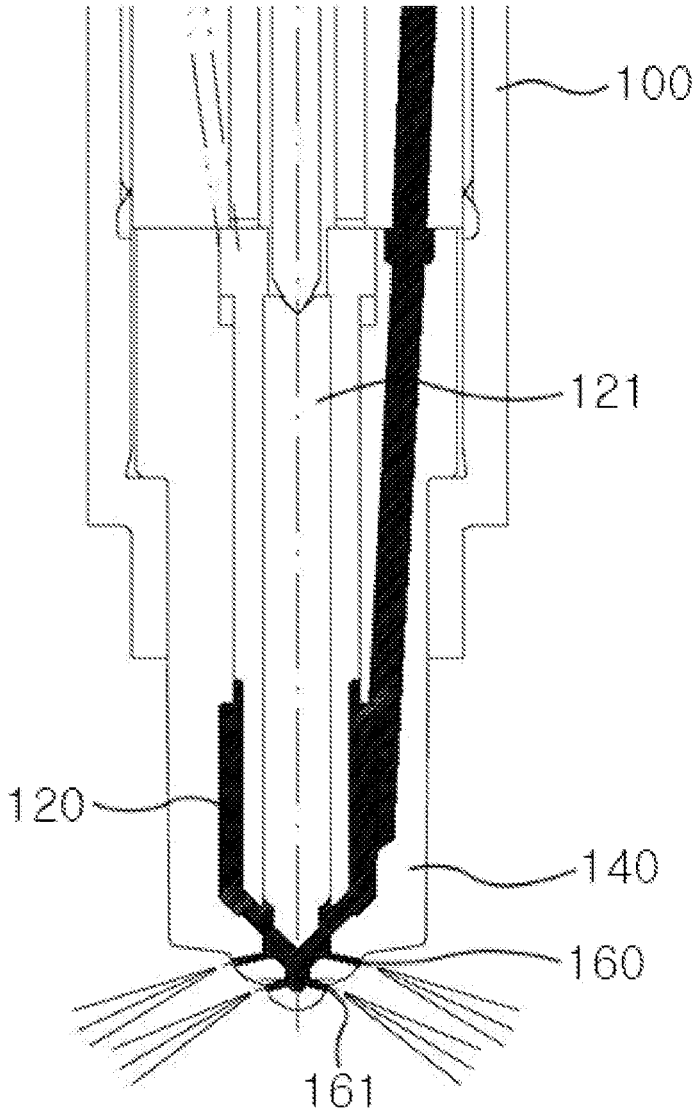
FIG. 9 is a cross sectional view illustrating injection by a low pressure nozzle hole and a high pressure nozzle hole during a process of injecting fuel by a stroke of a needle valve in primary and secondary injection.
Figure 10:
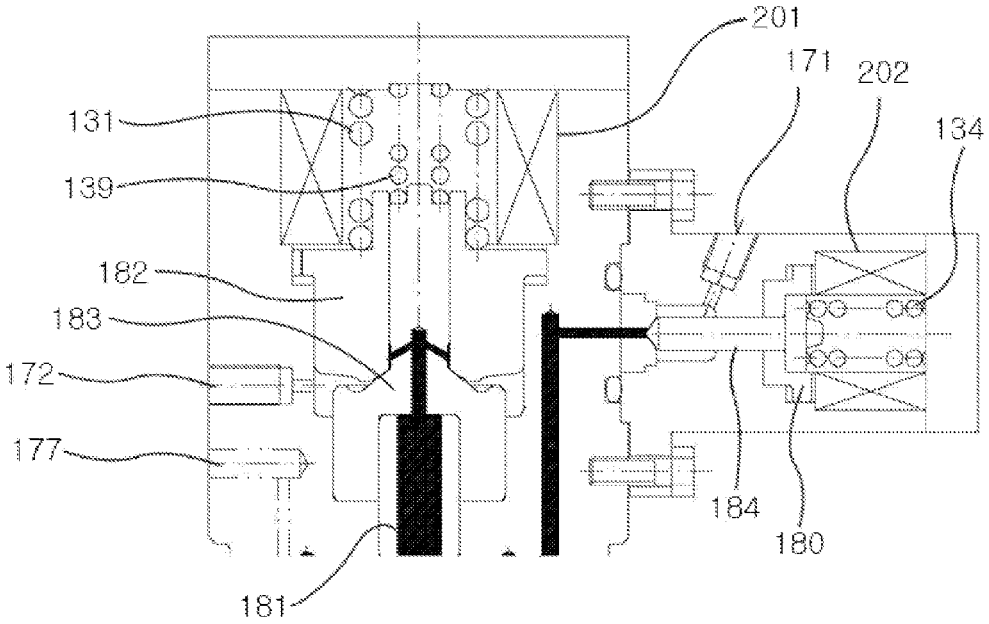
FIG. 10 is a cross sectional view illustrating a state in which fuel is filled during a process of sequentially pressing a solenoid valve and operating primary and secondary solenoids.
Figure 11:
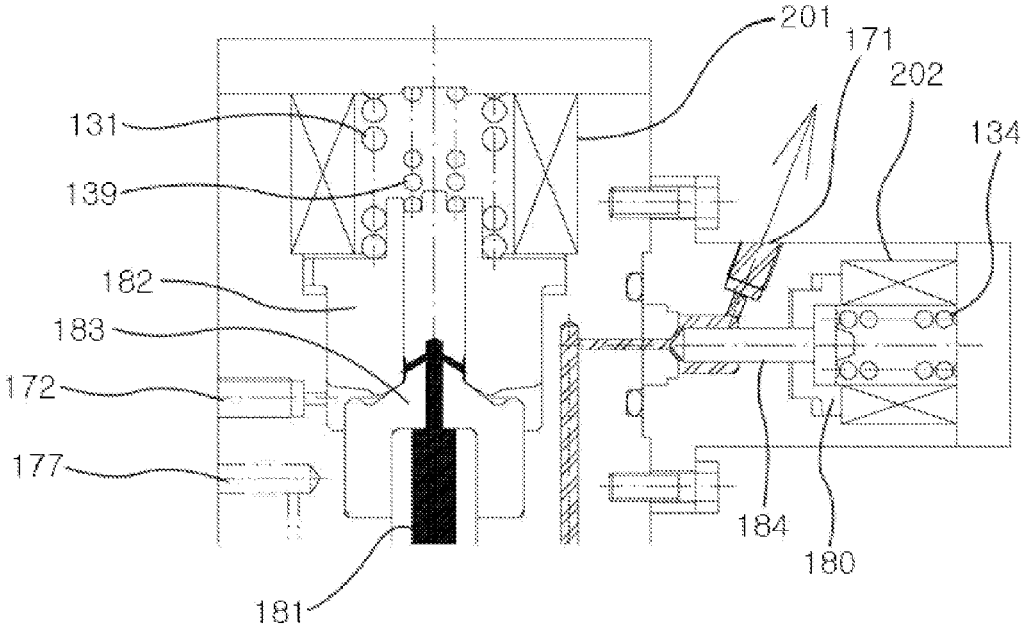
FIG. 11 is a cross sectional view illustrating injection by a fuel discharging hole for a low pressure during a process of sequentially pressing a solenoid valve and operating primary and secondary solenoids.
Figure 12:
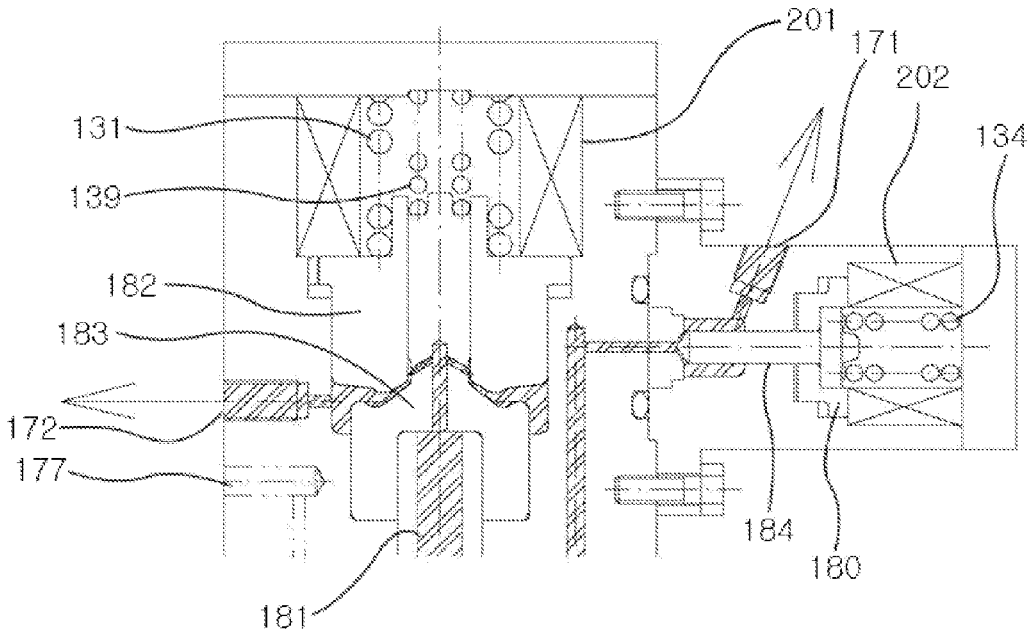
FIG. 12 is a cross sectional view illustrating injection by a fuel discharging hole for a high pressure during a process of sequentially pressing a solenoid valve and operating primary and secondary solenoids.

FIG. 1, FIG. 2 are example cross sectional views illustrating a fuel injection valve according to the present invention, FIG. 3 shows an embodiment prior to operating a solenoid in order not to allow injection at a load pressure according to the present invention, wherein relative pressure is increased by providing pressure to a pressure booster, FIG. 4 is an example cross sectional view illustrating an embodiment of primary fuel injection by operating a low pressure primary solenoid to discharge the relative pressure, FIG. 5 is an example cross sectional view illustrating an embodiment of secondary fuel injection by operating a secondary solenoid at high speed and high load pressure, FIGS. 6, 7, 8, 9 show images of primary injection and secondary injection through primary and secondary needle valves having a predetermined stroke, and FIGS. 10, 11, 12 show images of discharging the relative pressure to carry out the primary injection and the secondary injection by interworking two solenoid valves to operate.

Figure 13:
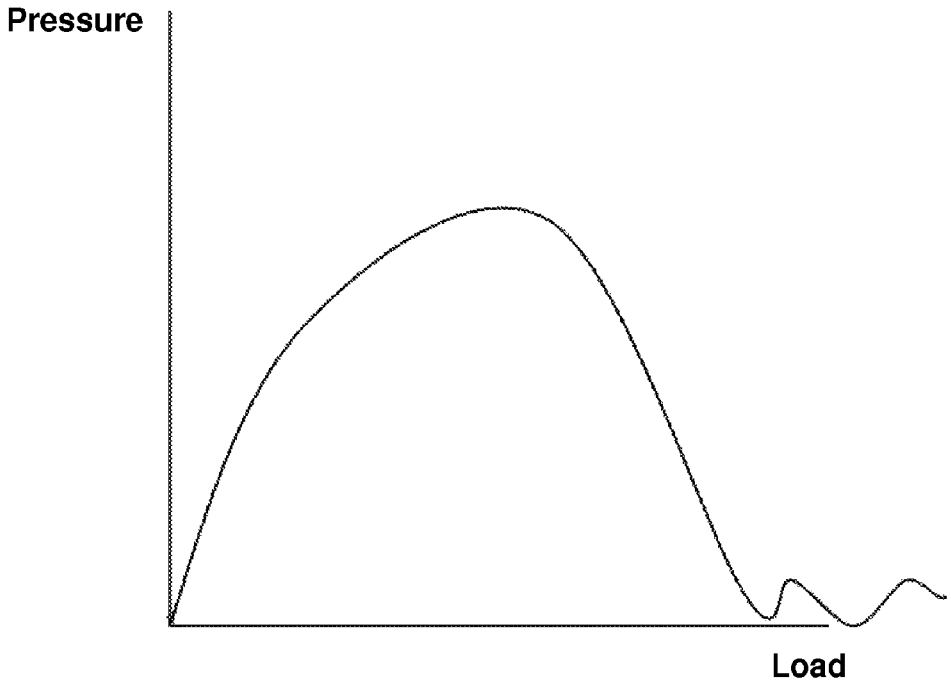
FIG. 13 PRIOR ART
FIG. 13 is a graph illustrating a pressure change of a conventional pressure valve.
Figure 14:
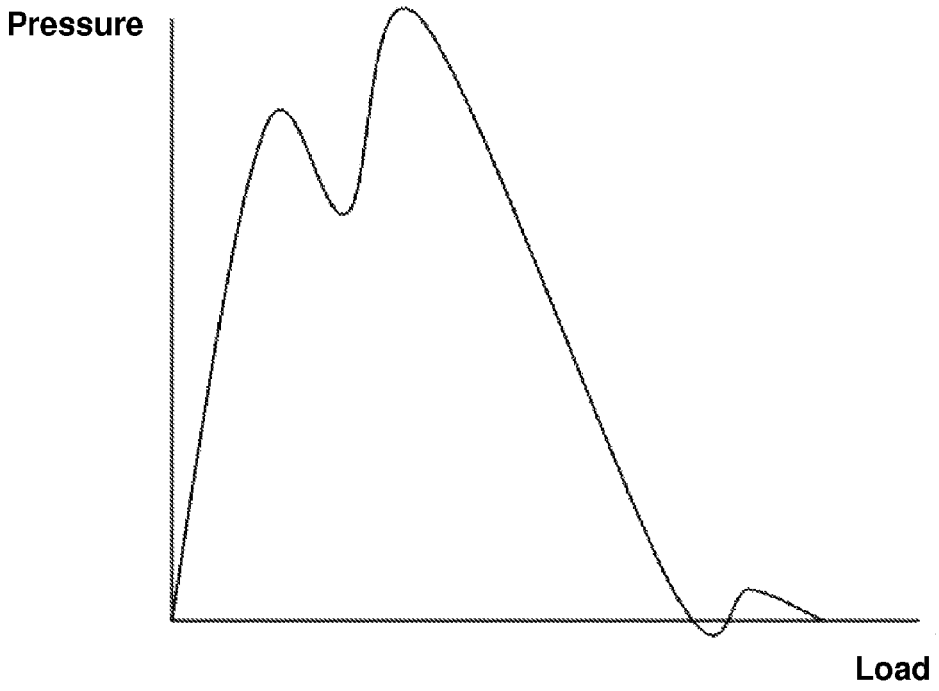
FIG. 14 is a graph illustrating injection by high pressure even in a case of low load, which is a characteristic of the present invention.
Figure 15:
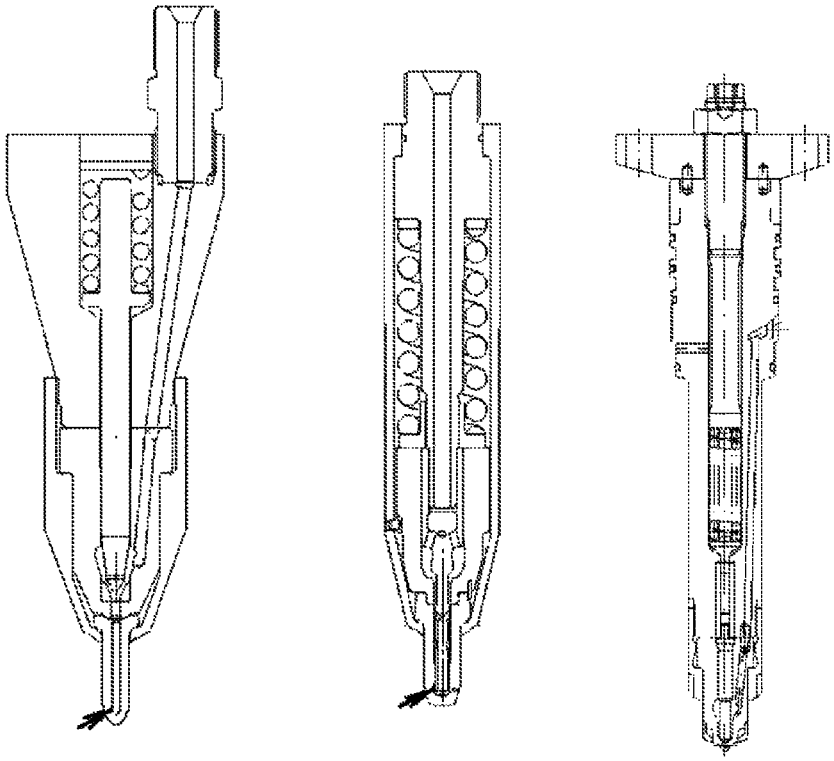
FIG. 15 PRIOR ART
FIG. 15 is a schematic view illustrating a conventional fuel injection valve.

FIG. 13 is a general injection graph in case of low load, FIG. 14 is a graph illustrating the secondary injection subsequent to the primary injection at high pressure even in the case of the low load, and FIG. 15 is a schematic view illustrating a conventional fuel injection valve.

Referring to FIG. 1, in a fuel valve for a diesel engine, the present invention is configured to include a fuel valve block 101 connected with a high pressure pipe, a nozzle holder 100 which surrounds an entire fuel valve, a high pressure needle spring 133 which is connected with a fuel passage bush 181 and operates at high pressure, a high pressure booster spindle 141 which is coupled with the high pressure needle spring 133 and keep high pressure at low speed and low load pressure, a high pressure needle valve 121 coupled with the high pressure booster spindle 141, a low pressure needle spring 132 which surrounds the high pressure booster spindle, a low pressure booster spindle 143 coupled with the low pressure needle spring 132 such that the high pressure booster spindle 141 passes therethrough, a low pressure needle valve 120 coupled with the pressure booster spindle 141, a nozzle 140 on which a low pressure nozzle hole 160 for injecting fuel to a cylinder and a high pressure nozzle hole 161 for injecting fuel to the cylinder at high speed and high load pressure are fabricated, a low pressure solenoid valve 202 and a high pressure solenoid valve 201 which adjust an injection time point at low pressure and high pressure, lifting bush valves 180, 181, 182 coupled with the low pressure solenoid valve 202 and the high pressure solenoid valve 201, and low pressure shuttle valves 150, 151 and a high pressure shuttle valve 155 which distinguishes fuel depending on a pressure difference.

Pressure of fuel flowing into the fuel valve is divided into two phases of low load and high load and a two phase operation is such that the low pressure solenoid valve 202 and the high pressure solenoid valve 201 are differentially opened according to pressure and the pressure of the fuel entering into the fuel is turned to relative pressure by the booster spindle to inject the fuel at low load and high pressure and the fuel injection nozzle hole is opened differentially according to pressure.

Also, before the fuel passes through the fuel oil inlet 170 and arrives at the high pressure booster spindle 141 and the 143, fuel pressure in the fuel oil inlet 170 and fuel standby pressure is applied to the booster spindle through the low pressure shuttle valve 150, the high pressure shuttle valve 151, and when pressure is decreased at a low pressure fuel drainage 171 and a high pressure fuel drainage 172, interruption and flow may be provided by overcoming a pressure difference therebetween.

In other words, the opening pressure is increased at the low pressure needle valve 120 and the high pressure needle valve 121 by using the high pressure booster spindle 141, the low pressure booster spindle 143, the low pressure needle spring 132, and the high pressure needle spring 133, compared with an atmospheric pressure, and in this case, the high pressure solenoid valve spring 131 and the low pressure solenoid valve spring 134 having a greater force than the opening pressure supports the low pressure lifting bush valve 180 and the high pressure lifting bush valve 182 to adjust an injection timing through the two-phase solenoid valves 201, 202 and perform injection.

Here, pressure is formed at low pressure without opening because of a relative pressure between the low pressure booster spindle 141 and the high pressure booster spindle 143 which assists in increasing pressure, and the relative pressure may be adjusted to desired high pressure.

The fuel stands by at the low pressure needle valve 120 within the nozzle 140, and when the relative pressure is discharged to the low pressure fuel drainage 171 through the low pressure shuttle valve 150 through the primary solenoid, the low pressure needle valve 120 is opened to perform the primary injection through the low pressure nozzle hole 160 and, when pressure, which stands by at the high pressure needle valve 121 in a space where the low pressure needle valve 120 is opened, is discharged to the high pressure fuel drainage 172 through the high pressure shuttle valve 151 by operating the secondary solenoid valve, the high pressure needle valve 121 is opened to injection through the high load nozzle hole 161.

Referring to FIG. 2, in a two solenoid valve relay with a two-phase fuel injection valve according to an exemplary embodiment of the present invention, fuel pressure stands by from the low pressure needle valve 120 to the high pressure needle valve 121 through the fuel oil inlet 170 and fuel through the lower pressure shuttle valve 150 and the high pressure shuttle valve 151 affects the low pressure booster spindle 143 and the high pressure booster spindle 141 to operate at the atmospheric pressure such that the low pressure needle valve 120 and the high pressure needle valve 121 stand by at pressure higher than the pressure of the fuel introduced from an injection hole.

Here, when required pressure of the low load is reached, the low pressure solenoid 202 is operated such that the relative pressure applied to the low pressure booster spindle 141 is discharged to the drainage 171 through the lifting bush valve 181 to interwork with the low pressure needle valve 120, thereby opening the low pressure nozzle hole 160, and when the high pressure of an engine high load is reached, the high pressure solenoid 201 is operated such that the relative pressure applied to the high pressure booster spindle 143 is discharged to the drainage 172 through the lifting bush valve 181, thus interworking with the high pressure needle valve 121 to be openly injected to a nozzle at which the high pressure nozzle hole 161 is fabricated.

Hereinafter, an operation of an exemplary embodiment of the present invention is described below with connection to the accompanying drawings. Low pressure in the present invention refers to the opening pressure at which the fuel injection starts and high pressure herein refers to pressure set as the relative pressure with respect to the spring to open the nozzle hole secondarily when pressure greater than the opening pressure is formed within the fuel valve.

Figure 7:
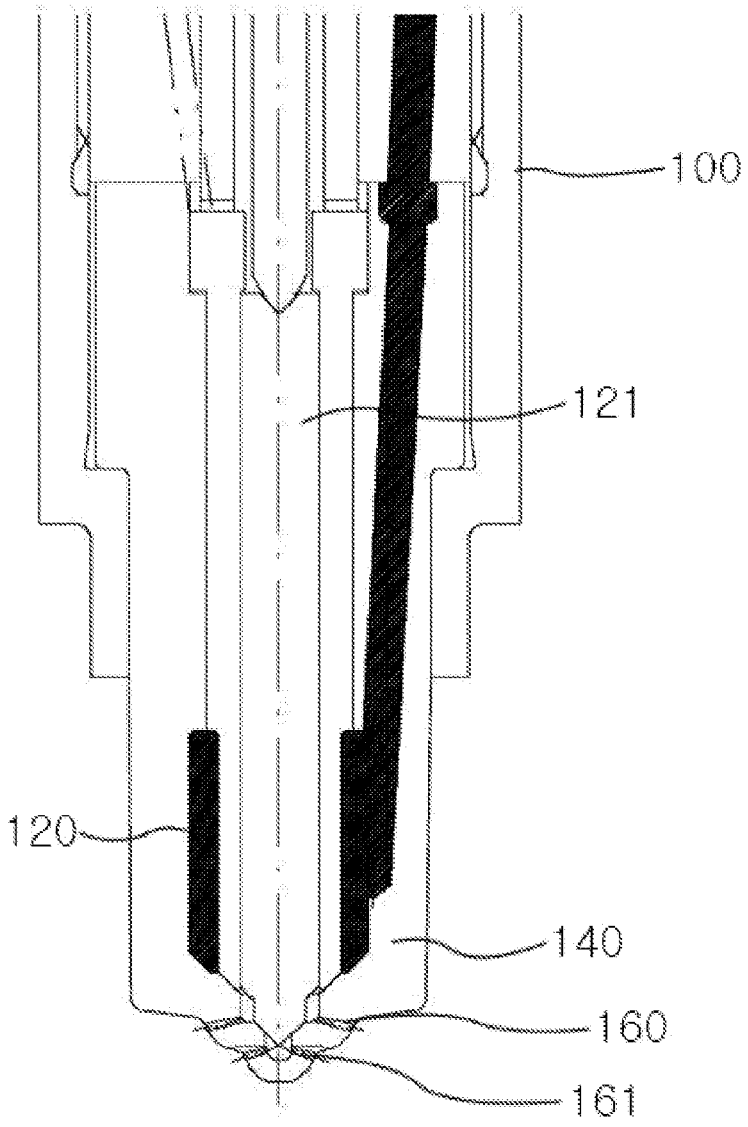
FIG. 7 is a cross sectional view illustrating a state in which fuel is filled during a process of injecting fuel by a stroke of a needle valve in primary and secondary injection.

As shown in FIGS. 3, 7, 10, prior to injecting the fuel, fuel which enters into the fuel valve through a high pressure pipe connected with the fuel pump is fully filled within a passage of the fuel valve, however, the pressure thereof is not greater than a resilient force of the low pressure spring 132 and the high pressure spring 133 as well as the low pressure booster spindle 143 and the high pressure booster spindle 141 such that the pressure is not discharged outside but stands by while increasing the pressure.

When a time point for fuel injection at the low load arrives, as shown in FIGS. 4, 8, 11, by operating according to the opening pressure and the injection timing set in the low pressure solenoid valve 202, the low pressure relative pressure is discharged through the low pressure fuel drainage 171 such that pressure applied to the low pressure needle valve 120 is increased to open the low pressure needle valve 120, thereby beginning the fuel injection to the low pressure nozzle hole 160.

As shown in FIGS. 5, 9, 12, in an operation in relay of the primary solenoid valve according to the opening pressure and the injection timing set in the secondary high pressure solenoid valve 201, relative pressure for high pressure is discharged through the high pressure fuel drainage 172 such that pressure applied to the high pressure needle valve 121 is increased to open the high pressure needle valve 121 to begin fuel injection while sequentially injecting fuel to the high pressure nozzle hole 161 at the same time by pressure of the fuel oil.

At a time point when the fuel injection is finished, the pressure within the fuel valve is decreased and when the pressure is decreased lower than pressure which is sufficient to press against resilience of the low pressure needle spring 132 and the high pressure needle spring 133 sequentially or simultaneously, the low pressure needle valve 120 and the high pressure needle valve 121 are pushed downward to close the low pressure nozzle hole 160 and the high pressure nozzle hole 161, thereby finishing a cycle of the fuel injection.

FIG. 13 is a graph illustrating a pressure change of a conventional pressure valve, and FIG. 8*b* shows a characteristic of the present invention that fuel is injected at high pressure in two phases even at an initial low load such that efficiency and fuel economy is improved by injecting fuel at high pressure even at low load.

The present invention should not be construed as limited to particular preferable exemplary embodiments set forth herein but rather should be understood to cover various modifications which will be apparent to those skilled in the art without departing from the spirit and scope of the present invention as defined by the appended claims.

What is claimed is:

1. A two-phase fuel injection valve for injecting fuel into a cylinder for a diesel engine, comprising:

a distinguishing means distinguishing a pressure of fuel entering to a fuel valve into two phases of a low load and a high load, wherein the low load requires lower engine power and the high load requires higher engine power;

a nozzle including a low pressure nozzle hole which is opened at the low load and a high pressure nozzle hole which is opened at the high load;

a low pressure injection means injecting the fuel by opening only the low pressure nozzle hole in case of the low load to inject the fuel; and a high pressure injection means injecting the fuel by simultaneously opening the low pressure nozzle hole as well as the high pressure nozzle hole in case of the high load to inject the fuel, wherein the distinguishing means includes a low pressure solenoid valve opening only a low pressure nozzle valve when the low load is applied thereto, and a high pressure solenoid valve operating with the low pressure solenoid valve and opening the low pressure nozzle valve and the high pressure nozzle hole simultaneously when the high load is applied thereto.

2. The two-phase fuel injection valve for the diesel engine of claim 1, wherein the low pressure injection means comprises:

a low pressure needle spring connected with the low pressure solenoid valve through a fuel passage;

a low pressure booster spindle connected with the low pressure needle spring;

a low pressure needle valve connected with the low pressure booster spindle; and a low pressure shuttle valve configured to discharge the fuel at a low pressure.

3. The two-phase fuel injection valve for the diesel engine of claim 2, wherein the low pressure injection means stands by fuel pressure from the low pressure needle valve to a high pressure needle valve through a fuel oil inlet, wherein, at the same time, fuel through the lower pressure shuttle valve and a high pressure shuttle valve affect the low pressure booster spindle and a high pressure booster spindle to operate at atmospheric pressure such that the low pressure needle valve and the high pressure needle valve stand by at pressure higher than pressure of the fuel entering from an injection hole, and when required pressure of the low load is reached, the low pressure solenoid is operated such that relative pressure applied to the low pressure booster spindle is discharged to a drainage through a lifting bush valve to interwork with the low pressure needle valve, thereby opening the low pressure nozzle hole to inject the fuel.

4. The two-phase fuel injection valve for the diesel engine of claim 1, wherein the high pressure injection means comprises:

a high pressure needle spring connected with the high pressure solenoid valve through a fuel passage;

a high pressure booster spindle connected with the high pressure needle spring; and a high pressure needle valve connected with the high pressure booster spindle.

5. The two-phase fuel injection valve for the diesel engine of claim 4, wherein fuel pressure stands by from a low pressure needle valve to the high pressure needle valve through a fuel oil inlet wherein, at the same time, fuel through a lower pressure shuttle valve and a high pressure shuttle valve affect a low pressure booster spindle and the high pressure booster spindle to operate at atmospheric pressure such that the low pressure needle valve and the high pressure needle valve stand by at pressure higher than pressure of the fuel entering from an injection hole, and when required pressure of the high load is reached, a low pressure solenoid valve is operated such that relative pressure applied to the high pressure booster spindle is discharged to a drainage through a lifting bush valve to interwork with the high pressure needle valve, thereby openly injecting the fuel through a nozzle on which the high pressure nozzle hole is fabricated.

6. The two-phase fuel injection valve for the diesel engine of claim 1, wherein the fuel injection valve for injecting fuel into a cylinder in the diesel engine further comprises:

a fuel valve block connected with a high pressure pipe, a nozzle holder surrounding an entire fuel valve, a high pressure needle spring which is connected with a fuel passage bush and operates at high pressure, a high pressure booster spindle coupled with the high pressure needle spring and keeping high pressure at low speed and low load pressure, a high pressure needle valve coupled with the high pressure booster spindle, a low pressure needle spring surrounding the high pressure booster spindle, a low pressure booster spindle coupled with the low pressure needle spring such that the high pressure booster spindle passes therethrough, a low pressure needle valve coupled with the pressure booster spindle, the nozzle on which the low pressure nozzle hole for injecting the fuel to the cylinder and the high pressure nozzle hole for injecting the fuel to the cylinder at high speed and high load pressure are fabricated, the low pressure solenoid valve and the high pressure solenoid valve which adjust an injection time point at a low pressure and a high pressure, lifting bush valves coupled with the low pressure solenoid valve and the high pressure solenoid valve, and a low pressure shuttle valve and a high pressure shuttle valve which distinguish the fuel depending on a pressure difference.

* * * * *